US010953452B2

(12) United States Patent
Banno et al.

(10) Patent No.: US 10,953,452 B2
(45) Date of Patent: Mar. 23, 2021

(54) PUNCH PRESS

(71) Applicant: TOYOTA BOSHOKU KABUSHIKI KAISHA, Aichi (JP)

(72) Inventors: Hajime Banno, Tokai (JP); Shinpei Ono, Yokkaichi (JP)

(73) Assignee: TOYOTA BOSHOKU KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/031,661

(22) Filed: Jul. 10, 2018

(65) Prior Publication Data

US 2019/0054516 A1 Feb. 21, 2019

(30) Foreign Application Priority Data

Aug. 16, 2017 (JP) ..... JP2017-157089

(51) Int. Cl.
*B21D 28/12* (2006.01)
*B21D 28/22* (2006.01)
(Continued)

(52) U.S. Cl.
CPC ..... *B21D 28/12* (2013.01); *B21D 28/002* (2013.01); *B21D 28/20* (2013.01); *B21D 28/22* (2013.01); *B21D 28/246* (2013.01)

(58) Field of Classification Search
CPC ..... B21D 28/12; B21D 28/002; B21D 28/20; B21D 28/22; B21D 28/246
See application file for complete search history.

(56) References Cited

U.S. PATENT DOCUMENTS 4,555,966 A 12/1985 Klingel
4,569,267 A 2/1986 Klingel
(Continued)

FOREIGN PATENT DOCUMENTS

EP 0108935 5/1984
JP S5517628 2/1980
(Continued)

OTHER PUBLICATIONS

Extended European Search Report in counterpart European Application No. EP18182130.7, dated Dec. 17, 2018.
(Continued)

*Primary Examiner* — Kenneth E Peterson
*Assistant Examiner* — Liang Dong
(74) *Attorney, Agent, or Firm* — Greenblum & Bernstein, P.L.C.

(57) ABSTRACT

A punch press includes a die, a punch, a support that supports the punch, a shifting member, and a rotating mechanism. The shifting member includes an opposing surface that opposes the punch. The shifting member is movable toward and away from the die together with the support and the punch and rotatable about an axis extending in a direction in which the shifting member moves toward and away from the die. The shifting member includes a recess in the opposing surface. The rotating mechanism rotates the shifting member about the axis to shift the shifting member between an abutment position where the basal end surface of the punch is abut against the opposing surface and a retraction position where the basal end surface of the punch is retracted into the recess.

5 Claims, 7 Drawing Sheets

(51) Int. Cl.

| | |
|---|---|
| ***B21D 28/20*** | (2006.01) |
| ***B21D 28/00*** | (2006.01) |
| ***B21D 28/24*** | (2006.01) |

(56) References Cited

U.S. PATENT DOCUMENTS

| | | | | |
|---|---|---|---|---|
| 5,701,782 | A * | 12/1997 | Padula | B21D 28/002 100/292 |
| 6,769,600 | B1 * | 8/2004 | Knox | B21D 28/22 234/98 |
| 7,337,531 | B2 * | 3/2008 | Neuenschwander | B21D 28/22 29/609 |
| 8,770,077 | B2 | 7/2014 | Hirata | |
| 2003/0177878 | A1 * | 9/2003 | Yang | B21D 28/246 83/13 |

FOREIGN PATENT DOCUMENTS

| | | |
|---|---|---|
| JP | S57152337 | 9/1982 |
| JP | H0230334 | 1/1990 |
| JP | 2011-224580 | 11/2011 |

OTHER PUBLICATIONS

Japanese Office Action in counterpart Japanese Application No. 2017-157089, dated Dec. 8, 2020 (and English translation thereof).

* cited by examiner

PUNCH PRESS

BACKGROUND OF THE INVENTION

The present invention relates to a punch press.

A known punch press is shiftable between a state in which a punching process is performed on a work with a punch and a state in which such a punching process is not performed (refer to, for example, Japanese Laid-Open Patent Publication No. 2011-224580).

The punch press described in the above publication includes a die on which a work is mounted, a punch located upward from the die opposing the die, and a lift that supports the punch to be vertically movable relative to the die. Further, the punch press includes a shifting member and an actuator. The shifting member is located upward from the punch and vertically movable relative to the die together with the lift and the punch. Further, the shifting member is movable straight (slidable) in a horizontal direction. A lower surface of the shifting member includes a recess into which an upper end of the punch is retracted. The actuator moves the shifting member straight in the horizontal direction.

In the punch press of the above publication, to perform a punching process on a work, the shifting member is arranged at a position where the lower surface of the shifting member is abut against an upper end surface of the punch (hereinafter referred to as the abutment position). In a state in which the shifting member is located at the abutment position, the shifting member, the punch, and the lift are pushed toward the die so that the punch punches the work.

When a punching process is not performed on a work, the actuator moves the shifting member straight so that the recess in the lower surface of the shifting member is located immediately above the upper end of the punch (hereinafter referred to as the retraction position). When the shifting member, the punch, and the lift are pushed toward the die in a state in which the shifting member is located at the retraction position, the upper end of the punch is retracted into the recess. This decreases the distance from the lower surface of the shifting member to a distal end (lower end) of the punch as compared with when the shifting member is located at the abutment position. Thus, the punch does not punch the work.

In the punch press of the above publication, the shifting member is moved straight and shifted between the abutment position and the retraction position. Space is required to move the entire shifting member straight. Thus, there is a limit to reduction in the space occupied by the punch press.

SUMMARY OF THE INVENTION

It is an object of the present invention to provide a punch press that allows for reduction in the occupied space.

A punch press that achieves the above object includes a die on which a work is mounted, a punch opposing the die, a support that supports the punch to be movable toward and away from the die, a shifting member, and a rotating mechanism. The shifting member includes an opposing surface that opposes a basal end surface of the punch. The shifting member is configured to be movable toward and away from the die together with the support and the punch and rotatable about an axis extending in a direction in which the shifting member moves toward and away from the die. The shifting member includes a recess in the opposing surface into which a basal end of the punch is retracted. The rotating mechanism rotates the shifting member about the axis to shift the shifting member between an abutment position where the basal end surface of the punch is abut against the opposing surface and a retraction position where the basal end of the punch is retracted into the recess.

In the above structure, when the shifting member is located at the abutment position, the basal end surface of the punch is abut against the opposing surface of the shifting member. When the shifting member, the punch, and the support are pushed toward the die, a process such as punching the work with the punch is performed.

When the shifting member is located at the retraction position, the basal end of each punch is retractable into the recess. When the shifting member, the punch, and the support are pushed toward the die, the basal end of the punch is retracted into the recess. This decreases the distance from the opposing surface of the shifting member to the distal end of the punch as compared with when the shifting member is located at the abutment position. Thus, for example, a process in which the work is not punched (including manner in which work is not machined) is performed.

Accordingly, with the above structure, the rotating mechanism rotates the shifting member to shift the shifting member between the abutment position and the retraction position. This eliminates the need to ensure space for linear movement and differs from a structure in which linear movement shifts the shifting member between the abutment position and the retraction position. This allows for reduction in the occupied space.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A first embodiment of a punch press will now be described with reference to the FIGS. 1 to 6.

Figure 4:
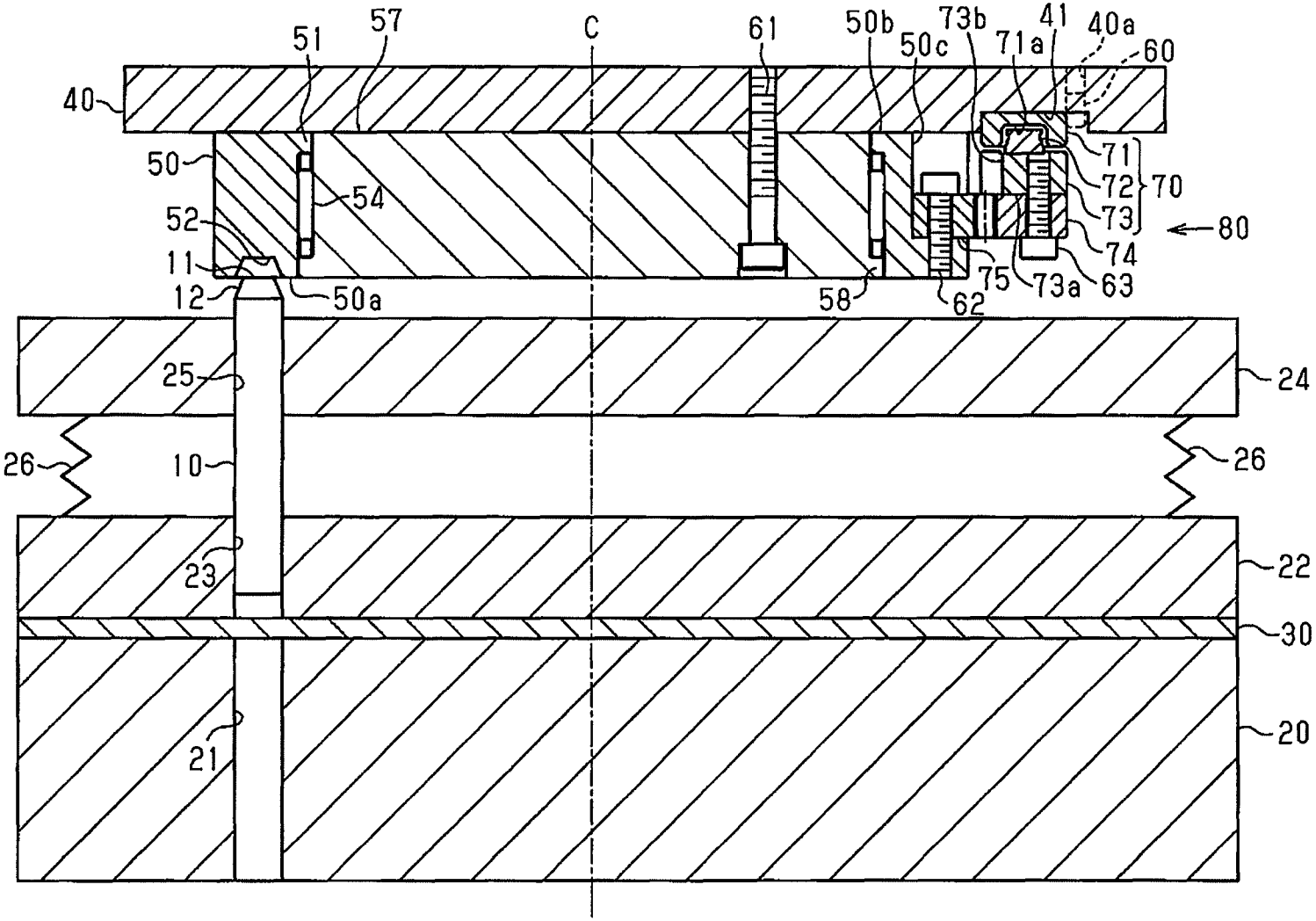
FIG. 4 is a cross-sectional view taken along line 4-4 in FIG. 2.

As shown in FIG. 4, the punch press includes a die 20 on which a work 30 formed from a metal plate is mounted, a pressing member 22 that is arranged upward from the die 20 pressing the work 30 toward the die 20, and a support 24 arranged upward from the pressing member 22. The support 24 is connected to the pressing member 22 by springs 26 and is movable relative to the pressing member 22 in a vertical direction.

The die 20, the pressing member 22, and the support 24 respectively include coaxial circular holes 21, 23, and 25 extending in the vertical direction.

A cylindrical punch 10 is coupled to the circular hole 25 of the support 24. The inner diameters of the circular holes 21 and 23 of the die 20 and the pressing member 22 are slightly larger than the outer diameter of the punch 10. The punch 10 is movable in the circular holes 21 and 23 and opposed to the die 20. Further, the support 24 supports the punch 10 to be movable toward and away from the die 20 in the vertical direction.

A base plate 40 is arranged upward from the punch 10. A shifting member 50 and a rotating mechanism 80 are arranged on the lower side of the base plate 40. The shifting member 50 is rotatable about an axis C extending in the vertical direction. The rotating mechanism 80 rotates the shifting member 50 about the axis C.

The structure of each element will now be described in detail.

Punch 10

Figure 1:
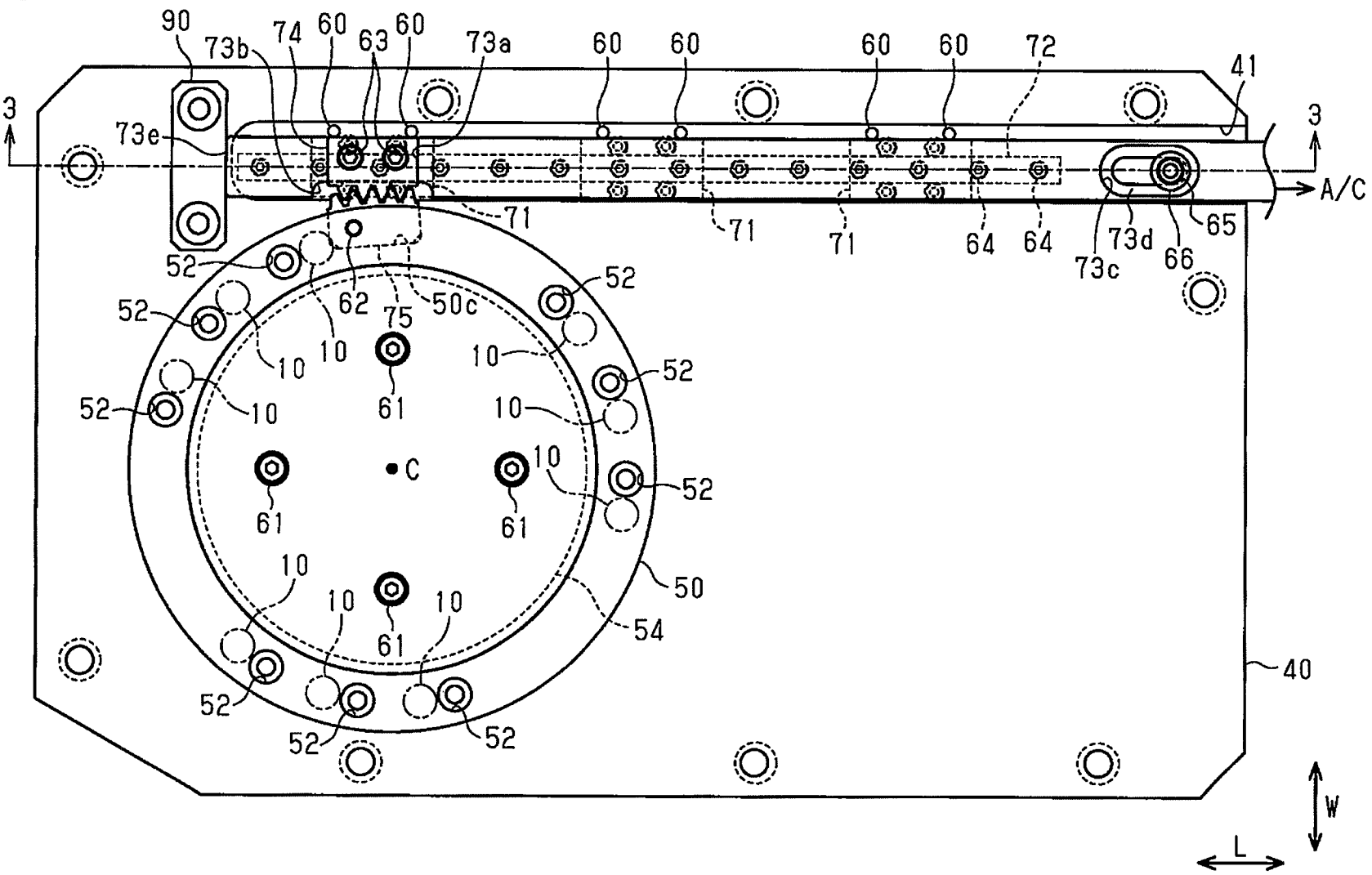
FIG. 1 is a bottom view showing a shifting member, a base plate, and a rotating mechanism at an abutment position in a first embodiment of a punch press.
Figure 2:
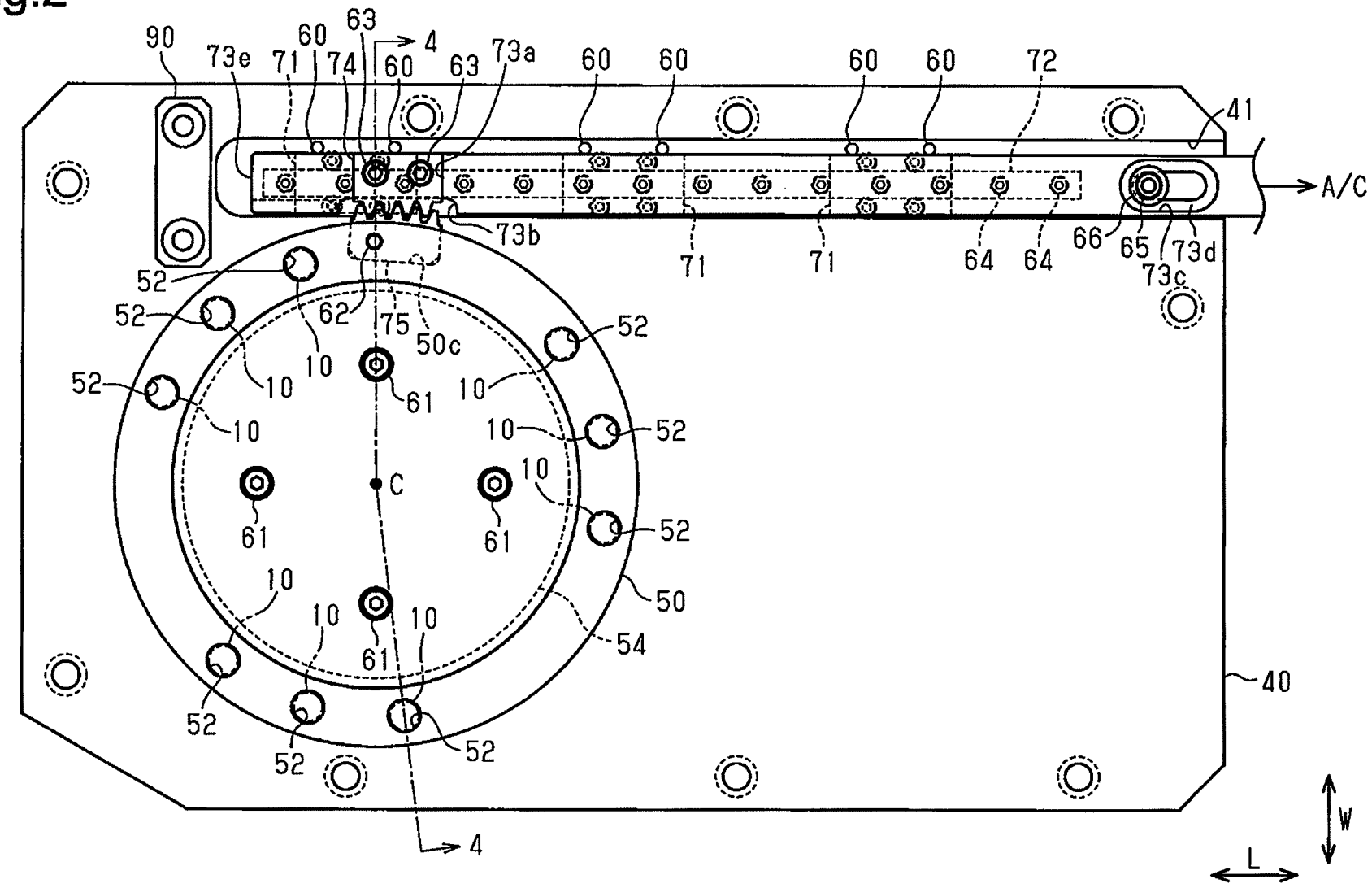
FIG. 2 is a bottom view corresponding to FIG. 1 and showing the shifting member, the base plate, and the rotating mechanism at a retraction position.

As shown by the double-dashed lines in FIGS. 1 and 2, a plurality of (nine in the present embodiment) punches 10 are arranged along a circle of which the center is the axis C. As shown in FIG. 4, each punch 10 includes a basal end surface 11 (upper end surface). The entire circumference of the basal end surface 11 is chamfered to form a chamfered portion 12.

Base Plate 40

As shown in FIGS. 1 and 2, the base plate 40 is rectangular. In the following description, the direction in which the long sides of the base plate 40 extend (sideward direction in FIGS. 1 and 2) is referred to as the lengthwise direction L, and the direction in which the short sides of the base plate 40 extend (vertical direction in FIGS. 1 and 2) is referred to as the widthwise direction W.

The base plate 40 is a member used to arrange the shifting member 50 and the rotating mechanism 80 upward from the punches 10.

As shown in FIGS. 1 and 2, a round support post 57, of which the center is the axis C, is fixed to one end of a lower surface of the base plate 40 in the lengthwise direction L (left side in FIGS. 1 and 2) by four bolts 61. Referring to FIG. 4, the entire outer circumferential surface of the lower end of the support post 57 defines a large-diameter portion 58. The shifting member 50 is rotationally supported by the support post 57.

As shown in FIGS. 1 and 2, one side of the base plate 40 in the widthwise direction W (upper side in FIGS. 1 and 2) includes an accommodation groove 41. The accommodation groove 41 opens in one end surface of the base plate 40 in the lengthwise direction L (right end surface in FIGS. 1 and 2) and extends in the lengthwise direction L toward the other end surface of the base plate 40 in the lengthwise direction L (left end surface in FIGS. 1 and 2).

As shown in FIGS. 1, 2, and 4, one side of the accommodation groove 41 in the widthwise direction W (upper side in FIGS. 1 and 2 and right side in FIG. 4) includes pin holes 40*a* that are spaced apart from one another and extend through the base plate 40 in the thickness-wise direction. A positioning pin 60 is fitted into each pin hole 40*a*. The positioning pins 60 project downward and position guide blocks 71, which will be described later, in the widthwise direction W.

Shifting Member 50

As shown in FIGS. 1, 2, and 4, the shifting member 50 is tubular and arranged on the outer circumference of the support post 57. The entire inner circumferential surface of the upper end of the shifting member 50 defines a small-diameter portion 51. Needle bearings 54 are arranged between the inner circumferential surface of the shifting member 50 and the outer circumferential surface of the support post 57 to support the shifting member 50 rotationally about the support post 57.

As shown in FIGS. 1 and 2, a plurality of recesses 52 are arranged in correspondence with the basal end surfaces of the punches 10 in an annular lower surface 50*a* of the shifting member 50, that is, an opposing surface that opposes the basal end surfaces 11 of the punches 10. As shown in FIG. 4, each recess 52 has a similar shape that is slightly larger than the chamfered portion 12 of the corresponding punch 10. As shown in FIG. 2, the relative positional relationship of the recesses 52 in the circumferential direction is the same as the relative positional relationship of the punches 10 in the circumferential direction. Thus, each recess 52 is configured to accommodate the basal end of the corresponding punch 10.

Rotating Mechanism 80

As shown in FIGS. 1, 2, and 4, the rotating mechanism 80 includes a pinion gear 75 fixed to the shifting member 50, a rack gear 74 meshed with the pinion gear 75, and a linear actuator 70 that moves the rack gear 74 back and forth in a tangential direction of a hypothetical circle of which the center is the axis C.

The pinion gear 75 corresponds to a first gear, and the rack gear 74 corresponds to a second gear.

As shown in FIG. 4, the shifting member 50 includes an upper surface 50*b* that is partially cut out from the outer circumferential surface to form a cutout 50*c*. The pinion gear 75 is fixed to the cutout 50*c* by a bolt 62. The pinion gear 75 includes a plurality of teeth extending outward in the radial direction from the outer circumferential surface of the shifting member 50.

As shown in FIGS. 1, 2, and 4, a plurality of (three in the present embodiment) guide blocks 71 are fixed to the bottom surface of the accommodation groove 41 of the base plate 40. The guide blocks 71 are spaced apart from one another in the lengthwise direction L. As shown in FIG. 4, each guide block 71 has a lower surface including a groove 71*a* that extends in the lengthwise direction L. The guide block 71 has a U-shaped cross section.

The groove 71*a* (refer to FIG. 4) of each guide block 71 accommodates a rail 72 extending in the lengthwise direction.

The two inner side surfaces of the groove 71*a* and the two side surfaces of the rail 72 each include a roller groove that extends in the lengthwise direction L. Rollers (not shown) are arranged between the roller grooves of the grooves 71*a* and the rail 72. The rail 72 is supported by the guide blocks 71 with the rollers so as to be movable relative to the guide blocks 71 in the lengthwise direction L.

An elongated slider 73 extending in the lengthwise direction L is fixed to a lower surface of the rail 72 by bolts 64.

As shown in FIGS. 1, 2, and 4, a lower surface of a distal end portion of the slider 73 is cut out to form a cutout 73*a* entirely in the widthwise direction W. The rack gear 74 is fixed to the cutout 73*a* by bolts 63. The cutout 73*a* includes two clearance grooves 73*b* cut out extending throughout the thickness-wise direction in the side surface of the slider 73 at the portion opposing the shifting member 50 to allow movement of the pinion gear 75.

Figure 3:
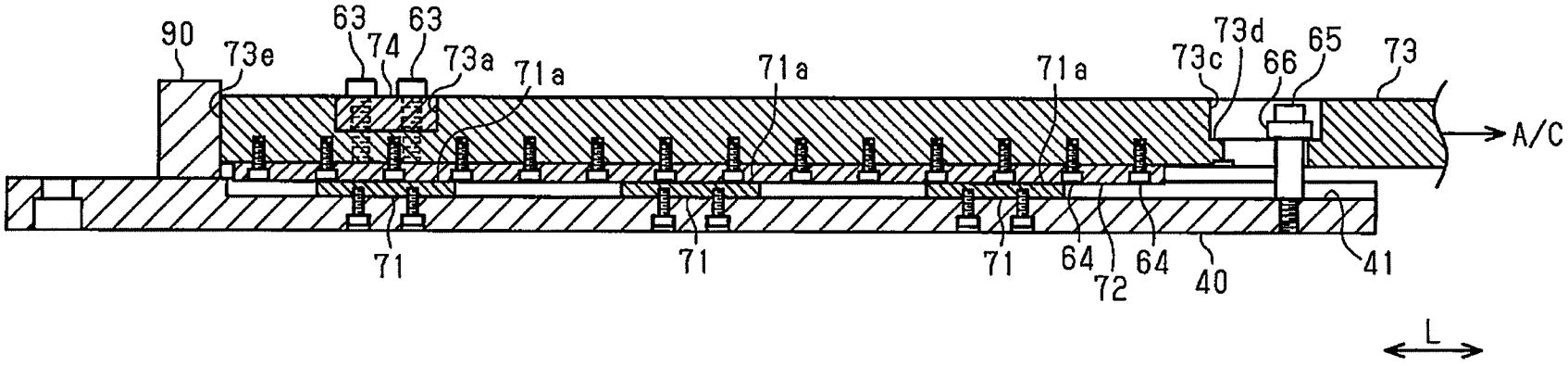
FIG. 3 is a cross-sectional view taken along line 3-3 in FIG. 1.

As shown in FIGS. 1 to 3, the portion of the slider 73 corresponding to one end (right end in FIGS. 1 to 3) of the base plate 40 includes a support hole 73*c* elongated in the lengthwise direction L. The support hole 73*c* extends through the slider 73 in the thickness-wise direction and includes a counterbore 73*d*.

A collar 66 and a support bolt 65 are inserted through the support hole 73*c* from below. The support bolt 65 is fixed to the bottom surface of the accommodation groove 41 of the base plate 40. Movement of the slider 73 relative to the base plate 40 in the lengthwise direction L is supported by the collar 66 to restrict displacement, vibration, and the like that occur when the slider 73 moves back and forth.

As shown in FIGS. 1 to 3, a stopper 90 is fixed to the lower surface of the base plate 40 at a portion located toward the distal end from a distal end surface 73*e* of the slider 73. The stopper 90 abuts against the distal end surface 73*e* to position the distal side of the slider 73.

An output shaft of an air cylinder A/C that moves the slider 73 back and forth in the lengthwise direction L is connected to a basal end of the slider 73.

In the present embodiment, the guide blocks 71, the rail 72, the slider 73, and the air cylinder A/C form the actuator 70 that is movable back and forth in the tangential direction of a hypothetical circle, the center of which is the axis C. That is, the actuator 70 is movable back and forth in the lengthwise direction L.

In the punch press, the rotating mechanism 80 rotates the shifting member 50 to shift the shifting member 50 between the abutment position where the basal end surface 11 of each punch 10 is abut against the lower surface 50*a* of the shifting member 50 and the retraction position where the basal end surface 11 of each punch 10 is retracted into the corresponding recess 52.

The operation of the present embodiment will now be described.

In the punch press of the present embodiment, the work 30 is machined as described below.

Figure 5:
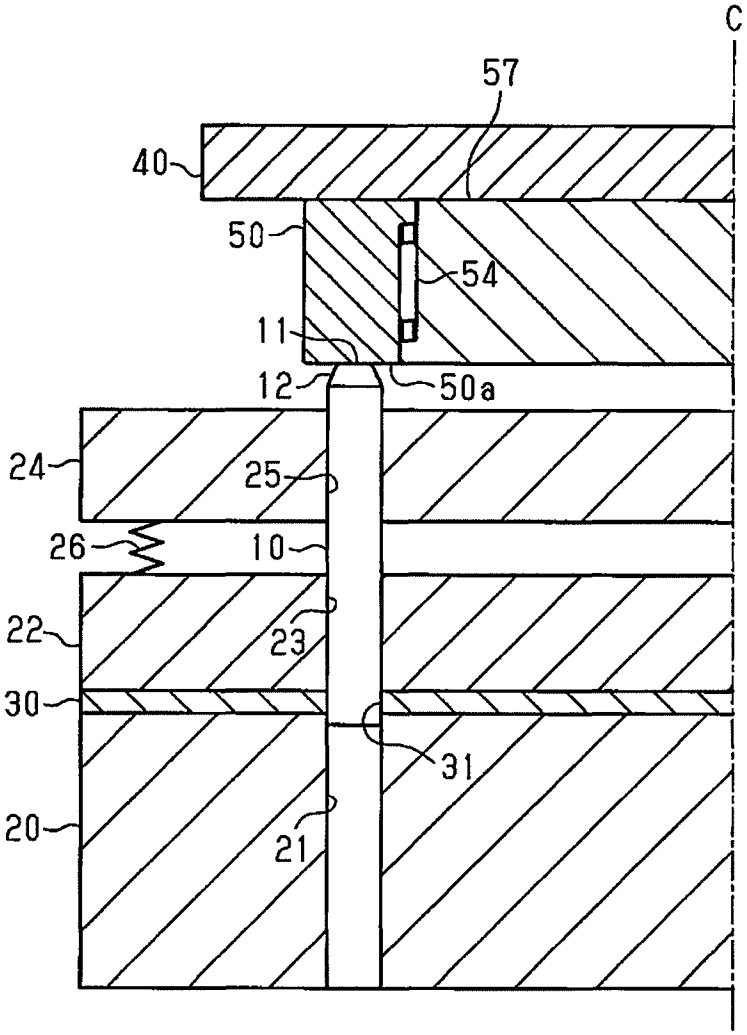
FIG. 5 is a cross-sectional view corresponding to FIG. 4 and showing a state in which the punch is located on the lowest point at the abutment position.

As shown in FIG. 5, when the shifting member 50 is located at the abutment position, the shifting member 50 is lowered together with a striker (not shown). This abuts the basal end surface 11 of each punch 10 against the lower surface 50*a* of the shifting member 50. Then, when the lower surface 50*a* of the shifting member 50 pushes the basal end surface 11 of the punch 10, the punch 10 and the support 24 move downward. As a result, the distal end of the punch 10 punches the work 30 and forms a punched hole 31.

Subsequently, the shifting member 50 is lifted together with the striker. This lifts the support 24 and the punch 10 with the resilient force of the springs 26 away from the work 30.

As shown in FIG. 2, when the air cylinder A/C moves the slider 73 toward the distal end, the rack gear 74 and the pinion gear 75 that are meshed together rotate the shifting member 50 from the abutment position to the retraction position.

Figure 6:
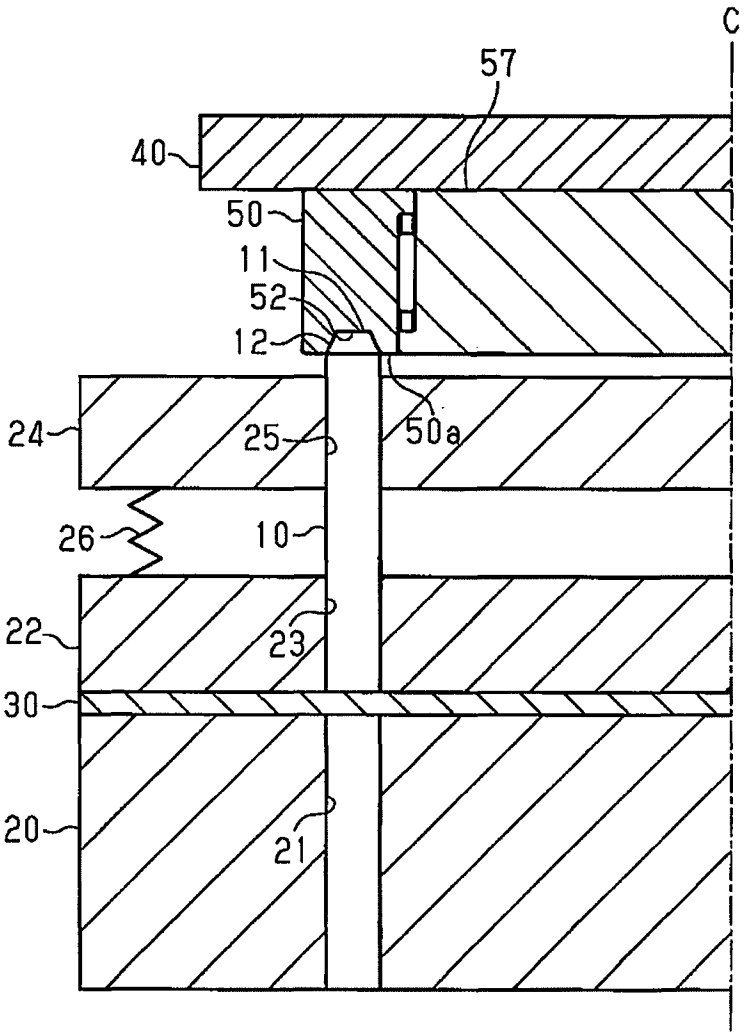
FIG. 6 is a cross-sectional view corresponding to FIG. 4 and showing a state in which the punch is located on the lowest point at the retraction position.

As shown in FIG. 6, when the shifting member 50 is located at the retraction position and the shifting member 50 is lowered together with the striker (not shown), the basal end of each punch 10 is retracted into the recess 52*a*. Then, the recess 52 pushes the basal end of the punch 10 and downwardly moves the punch 10 and the support 24. However, this decreases the distance from the lower surface 50*a* of the shifting member 50 to the distal end of the punch 10 as compared with when the shifting member 50 is located at the abutment position. Thus, the work 30 is not punched.

The punch press of the present embodiment has the advantages described below.

(1) The punch press includes the shifting member 50 that is rotatable about the axis C and the rotating mechanism 80 that rotates the shifting member 50. The shifting member 50 is movable toward and away from the die 20 together with the support 24 and the punch 10. Further, the shifting member 50 includes the recesses 52 so that the basal ends of the punches 10 are retracted into the lower surface 50*a* of the shifting member 50. The rotating mechanism 80 rotates the shifting member 50 about the axis C to shift the shifting member 50 between the abutment position where the basal end surface 11 of each punch 10 is abut against the lower surface 50*a* and the retraction position where the basal end of each punch 10 is retracted into the corresponding recess 52.

With such a structure, the rotating mechanism 80 rotates the shifting member 50 to shift the shifting member 50 between the abutment position and the retraction position. This structure eliminates the need to ensure space for linear movement and differs from a structure in which linear movement (sliding) shifts the shifting member between the abutment position and the retraction position. This allows for reduction in the occupied space.

(2) The rotating mechanism 80 includes the pinion gear 75 arranged on the shifting member 50, the linear actuator 70 movable back and forth in the tangential direction of the hypothetical circle (lengthwise direction L) of which the center is the axis C, and the rack gear 74 arranged on the actuator 70 and meshed with the pinion gear 75. The actuator 70 moves the rack gear 74 back and forth in the tangential direction (lengthwise direction L) to rotate the shifting member 50.

With such a structure, the rack gear 74 and the pinion gear 75, which are meshed together, convert linear motion of the linear actuator 70 into rotational motion of the shifting member 50. This ensures rotation of the shifting member 50 with a simple structure.

Second Embodiment

A second embodiment of the punch press will now be described with reference to FIG. 7.

In the second embodiment, like or the same reference numerals are given to those components that are the same as the corresponding components of the first embodiment. Such components will not be described in detail.

Figure 7:
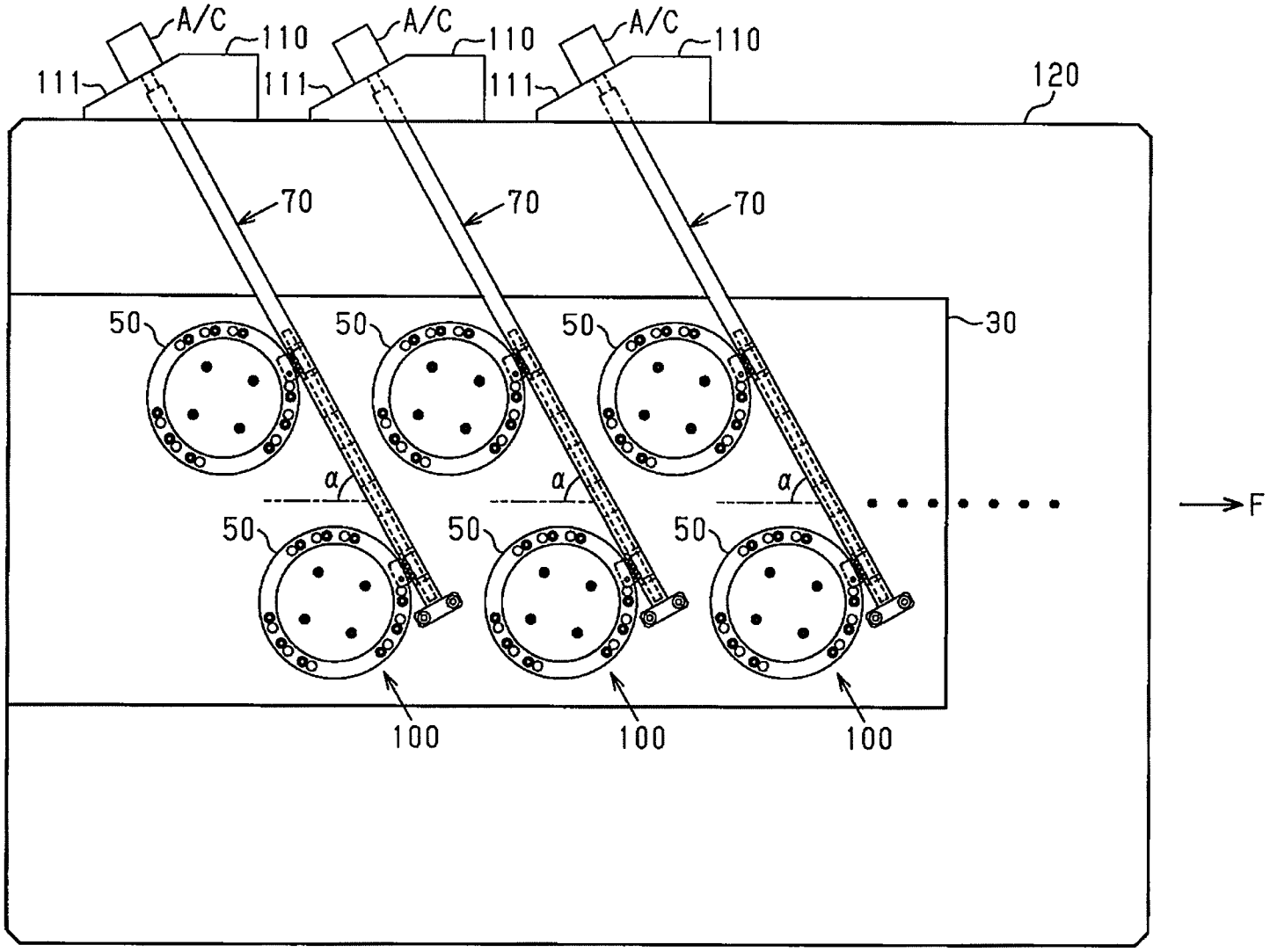
FIG. 7 is a plan view showing a second embodiment of a punch press.

As shown in FIG. 7, the punch press is a forward-feed device that feeds the work 30 in a predetermined forward direction F. A plurality of units 100 are arranged in the forward direction F and located upward from a die 120. Each unit 100 includes a plurality of (two in the present embodiment) shifting members 50 and a common actuator 70 that rotates the two shifting members 50. That is, in each unit 100, two rack gears 74 are fixed to the slider 73 of the single actuator 70 and spaced apart from each other in the lengthwise direction of the slider 73. Further, the two shifting members 50 of the unit 100 are arranged in correspondence with the two rack gears 74.

Each unit 100 includes an air cylinder A/C coupled to and abut against an inclined surface 111 of an inclined block 110. Thus, the lengthwise direction of the slider 73 of each unit 100 is inclined at a predetermined inclination angle $\alpha$ relative to the forward direction F.

The punch press of the second embodiment has the advantages described below in addition to advantages (1) and (2) of the first embodiment.

(3) The punch press includes two shifting members 50 and one actuator 70 that rotates the two shifting members 50.

Such a structure simultaneously rotates two shifting members 50 with the same actuator 70. This reduces the number of actuators 70.

(4) The two shifting members 50 are spaced apart from each other in the lengthwise direction of the slider 73, that is, the back-and-forth movement direction of the actuator 70.

Thus, the two adjacent shifting members 50 can be easily arranged near each other in the back-and-forth movement direction. This reduces the occupied space.

(5) The punch press is a forward-feed device that feeds the work 30 in the predetermined forward direction F. The punch press includes a plurality of units 100 arranged in the forward direction F. Each unit 100 includes two shifting members 50 and one actuator 70.

With such a structure, in addition to allowing the two shifting members 50 that are adjacent in the back-and-forth movement direction of the actuator 70 to be arranged near each other, the units 100 that are adjacent in the forward direction F can also be easily arranged near each other. Thus, the forward-feed punch press further reduces the occupied space.

MODIFIED EXAMPLES

It should be apparent to those skilled in the art that the present invention may be embodied in many other specific forms without departing from the spirit or scope of the invention. Particularly, it should be understood that the present invention may be embodied in the following forms.

In the second embodiment, the lengthwise direction of the slider 73 of each unit 100 may be orthogonal to the forward direction F.

In the second embodiment, there may be three or more shifting members 50 in each unit 100.

Figure 8:
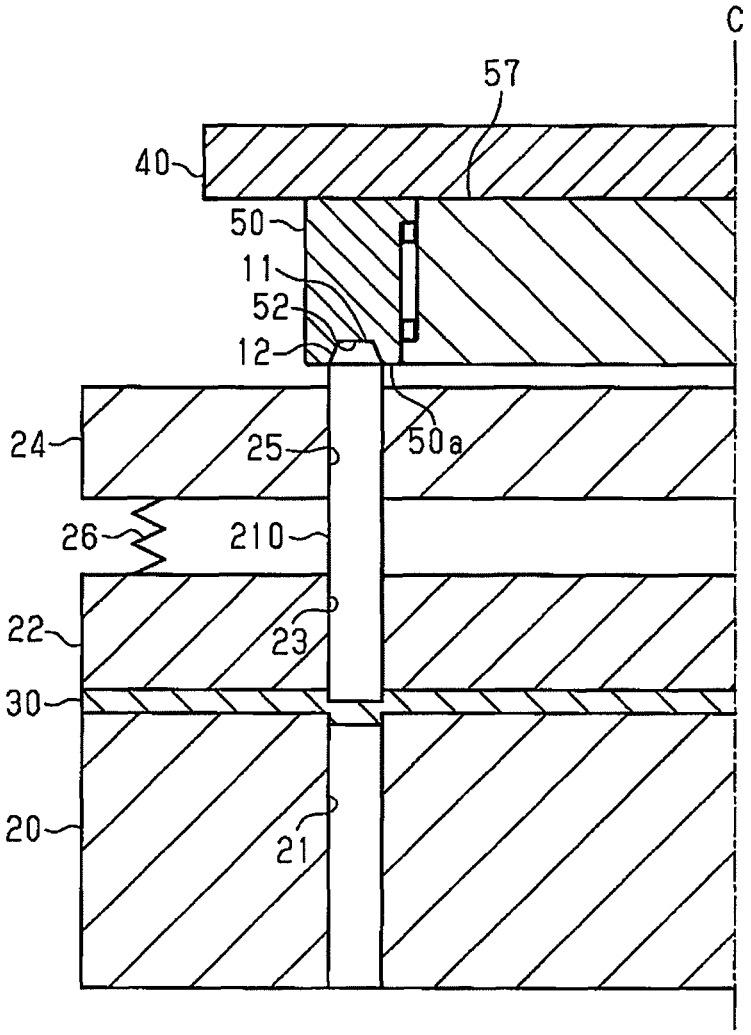
FIG. 8 is a cross-sectional view showing a modified example of a punch press in a state in which the punch is located on the lowest point at the retraction position.

When the shifting member 50 is located at the retraction position, as shown in FIG. 8, dowel machining may be performed to project the work 30 using a punch 210.

For example, the slider 73 may be sandwiched by the two shifting members 50 with the rack gears 74 arranged on the two side surfaces of the slider 73. In this case, two shifting members 50 can also be simultaneously rotated by the same actuator 70.

The pinion gear 75 may be formed integrally with the shifting member 50. The rack gear 74 may be formed integrally with the slider 73.

Instead of the actuator 70 using the air cylinder A/C, an actuator using a servomotor, an electromagnetic solenoid, or the like may be employed.

Instead of the rack gear 74 and the pinion gear 75 forming the rotating mechanism 80, a worm and a worm wheel may be used. In this case, a rotary actuator that rotates the worm is employed.

Instead of the stopper 90, a plunger may be used as a member used to position the slider 73.

Therefore, the present examples and embodiments are to be considered as illustrative and not restrictive and the invention is not to be limited to the details given herein, but may be modified within the scope and equivalence of the appended claims.

The invention claimed is:

1. A punch press operable to feed a work in a forward direction, the punch press comprising:

a die on which the work is mounted;

a punch opposing the die;

a support that supports the punch to be movable toward and away from the die;

a shifting member including an opposing surface that opposes a basal end surface of the punch, wherein the shifting member is configured to be movable toward and away from the die together with the support and the punch and rotatable about an axis extending in a direction in which the shifting member moves toward and away from the die, wherein the shifting member includes a recess in the opposing surface into which the basal end surface of the punch is retracted; and a rotating mechanism that rotates the shifting member about the axis to shift the shifting member between an abutment position where the basal end surface of the punch is abut against the opposing surface and a retraction position where the basal end surface of the punch is retracted into the recess, wherein the rotating mechanism includes:

a first gear arranged on the shifting member, a linear actuator configured to be movable back and forth in a tangential direction of a hypothetical circle of which a center is the axis, and a second gear arranged on the actuator and meshed with the first gear, the second gear is moved back and forth in the tangential direction by the actuator to rotate the shifting member, and wherein the shifting member is one of a plurality of shifting members, and the actuator solely rotates each of the shifting members, and wherein the actuator is inclined at a predetermined non-perpendicular inclination angle relative to the forward direction.

2. The punch press according to claim 1, wherein the first gear is a pinion gear arranged on part of a circumference of the hypothetical circle, and the second gear is a rack gear meshed with the pinion gear.

3. The punch press according to claim 1, wherein the punch press is a forward-feed device that feeds the work in the forward direction, and a plurality of units each including the plurality of shifting members and the actuator are arranged in the forward direction.

4. The punch press according to claim 1, wherein the forward direction is a linear forward direction.

5. The punch press according to claim 1, wherein the punch press is a progressive-type punch press, and the forward direction is a forward direction in the progressive-type punch press.

* * * * *